United States Patent [19]

Tomaka

[11] Patent Number: 4,840,127

[45] Date of Patent: Jun. 20, 1989

[54] TOP CHORD FOR OPEN TOP HOPPER CARS

[75] Inventor: Jan Z. Tomaka, Quebec, Canada

[73] Assignee: Alcan International Limited, Montreal, Canada

[21] Appl. No.: 128,930

[22] Filed: Dec. 4, 1987

[51] Int. Cl.[4] ..... B61D 17/08

[52] U.S. Cl. ..... 105/406.1; 105/396; 105/409; 105/411; 296/181; 296/187

[58] Field of Search ..... 105/406.1, 355, 409, 105/410, 404, 396, 411; 296/32, 181, 187, 191, 34, 36; 403/245, 246, 262, 230

[56] References Cited

U.S. PATENT DOCUMENTS 3,141,697 7/1964 Tenenbaum et al. ..... 296/181

4,252,067 2/1981 Stark ..... 105/406.1

*Primary Examiner*—Andres Kashnikow

*Assistant Examiner*—Mart T. Le

*Attorney, Agent, or Firm*—Renner, Otto, Boisselle & Sklar

[57] ABSTRACT

A new and useful top chord, and a new and useful container wall construction incorporating the top chord. The top chord has a tubular chord section and a special stepped stem integral with the tubular chord section. The stem has a relatively thick proximal portion connected with the tubular chord section and a relatively thinner distal portion extending from the thick portion. The thick proximal portion and the thinner distal portion co-operate to define a rectangular step having a predetermined thickness. The thickness of the step is designed so that the side wall can be closely sandwiched between the post and the thinner portion of the stem and the thick portion of the stem extends above the side wall and into facing relation with a portion of the post which extends above the side wall. The stem is bolted to the post and to the side wall with the thick portion bolted directly to the post and the thinner portion bolted to the post with the side wall sandwiched therebetween. Additionally, the tubular chord section has a depending lip designed to rest on a part of the post when the stem of the chord is bolted to the post. The foregoing structure is specifically designed to provide a secure and stable top chord that can resist the high, localized forces applied to gondola and open hopper-type railway cars during the unloading/shaking processes.

19 Claims, 2 Drawing Sheets

TOP CHORD FOR OPEN TOP HOPPER CARS

INTRODUCTION

The present invention relates to a top chord for an open top container of a transport vehicle such as a gondola-type railway car. More specifically, the invention relates to a new and useful top chord which provides a strong and stable structure even under the application of large localized forces typically encountered by such a railway car during operations such as shaking to unload material from the hopper or rotary inversion of the whole car in a rotary unloading device. Moreover, the invention provides a side wall construction which is believed useful for other types of transport vehicles (e.g., dump trucks) as well as for other types of structures (e.g. girders) requiring a strong, and stable wall construction.

BACKGROUND

An open top hopper or gondola-type railway car typically comprises a series of side walls, end walls and vertical posts that define the basic perimeter of a container for handling a body of material. The posts are spaced along the side walls and are designed to strengthen and reinforce the side walls of the container. A top chord structure extends along each of the side walls of the container to further strengthen and stablize the side walls.

In the handling of material, it is often necessary to subject the top chord of an open top hopper or gondola-type railway car to some high localized forces. For example, in unloading the contents of the car into a rotary dumper, it is conventional to clamp the top chord as the car is tilted or turned into an unloading position. Also, it is conventional to apply a shaker to the top chord of the car to agitate the contents of the car during the unloading process. Both such operations impose large localized forces on the top chord.

A top chord construction that has been used in the past has a P-shaped profile. That is, the chord has a tubular member with a generally rectangular profile, and a stem that is integrally connected with the tubular member. The stem is designed to be bolted to the side wall and the post of the container, in the manner illustrated in FIG. 5, in order to connect the chord to the container. More specifically, the side wall is a relatively flat, planar member, and the post is a generally U-shaped member with a pair of co-planar flanges that are juxtaposed with the side wall, with the legs of the U-shaped post extending outward from the side wall. The stem of the P-shaped top chord is then bolted to the side wall and to the post flanges in order to connect the top chord with the container. As shown in FIG. 5, the stem is bolted to the post with the side wall disposed between the stem and the post.

With the P-shaped chord profile shown in FIG. 5, the tubular, rectangular chord section of the chord is normally disposed above the post and the side wall. Also, the stem is spaced from the post. The forces applied to the top chord produce a high bending moment on the chord stem, and that bending moment can stress the chord and its fasteners to an undesirable extent, especially in the joint area where the stem of the chord is bolted to the post.

A particular problem with the chord structure of FIG. 5 is slippage in the area of the fastener. Specifically, when the chord of FIG. 5 is subjected to a high bending moment, the stresses on the fastener tend to cause cocking of the stem in the area of the fastener. With the stem spaced from the post, and the side wall sandwiched therebetween, the joint structure allows such cocking of the stem, and under high bending moments, such cocking can result in slippage in the joint area.

Another type of known top chord construction has a relatively flat chord section (rather than a tubular chord section), an integral stem for attachment to the side wall, and a lip connected with the chord section and designed to rest upon the side post. An additional reinforcing plate is bolted to the side wall and the stem of the top chord, with the side wall sandwiched between the stem and the reinforcing plate. The additional reinforcing plate functions to strengthen the joint between the side wall and the stem, to minimize the effect of bending moments applied to the top chord. However, that construction requires the additional reinforcement plate, and the chord itself is less stable than a tubular section. Additionally, it is not believed to be as effective as the structure of the present invention for minimizing the problem of slippage in the area of the fastener.

SUMMARY OF THE PRESENT INVENTION

The present invention provides a new and useful top chord, and a new and useful wall construction incorporating the top chord.

The top chord construction of the present invention is specifically designed to provide a secure and stable top chord that can resist the high, localized forces applied to open hopper and gondola-type railway cars during the unloading/shaking processes. Still further, the top chord construction of the present invention is useful in constructing walls for hoppers and other structures which may encounter high, localized forces.

According to the preferred form of the invention, the top chord has a tubular chord section and a special stepped stem integral with the tubular chord section. The stem has a relatively thick proximal portion connected with the tubular chord section and a relatively thinner distal portion extending from the thick portion. The thick proximal portion and the thinner distal portion co-operate to define a rectangular step having a predetermined thickness. The thickness of the step is designed so that the side wall can be closely sandwiched between the post and the thinner portion of the stem and the thick portion of the stem extends above the side wall and into facing relation with a portion of the post which extends above the side wall. The stem is bolted to the post and to the side wall with the thick portion bolted directly to the post and the thinner portion bolted to the post with the side wall sandwiched therebetween. Additionally, the tubular chord section has a depending lip designed to rest on a part of the post when the stem of the chord is bolted to the post.

The foregoing chord construction, and the wall structure incorporating the chord structure, is specifically designed to minimize the effect of high bending moments on the chord stem and fasteners. For example, the thick portion of the stem is bolted directly to the post which is a stronger structural member than the side wall. Additionally, the provision of the thin portion of the stem bolted to the post with the sandwiched side wall therebetween, and the lip which rests on the post, provides the wall with additional structural stability, without the need for a separate reinforcing member.

Such a wall structure has been found to effectively resist the type of localized forces often encountered in connection with the unloading/shaking of a gondola-type railway car. Moreover, such a wall structure is believed to be particularly effective at minimizing slippage in the area where the stem is fastened to the post.

While the preferred embodiment shows a tubular chord section, it is also contemplated that the chord section can have a relatively flat non-tubular upper surface. The chord section would still have a depending lip which engages the post, and the chord would still have a stepped stem with a thick portion bolted directly to the post and a thinner portion which sandwiches the side wall against the post in order to provide a secure and stable mounting.

The top chord of the present invention can be formed as a steel, aluminum or other structurally strong material. It is preferred to form the top chord of the present invention out of extruded aluminum.

The further features and advantages of the present invention will become further apparent from the following detailed description and the accompanying drawings.

DETAILED DESCRIPTION OF THE PREFERRED EMBODIMENT

Figure 1:
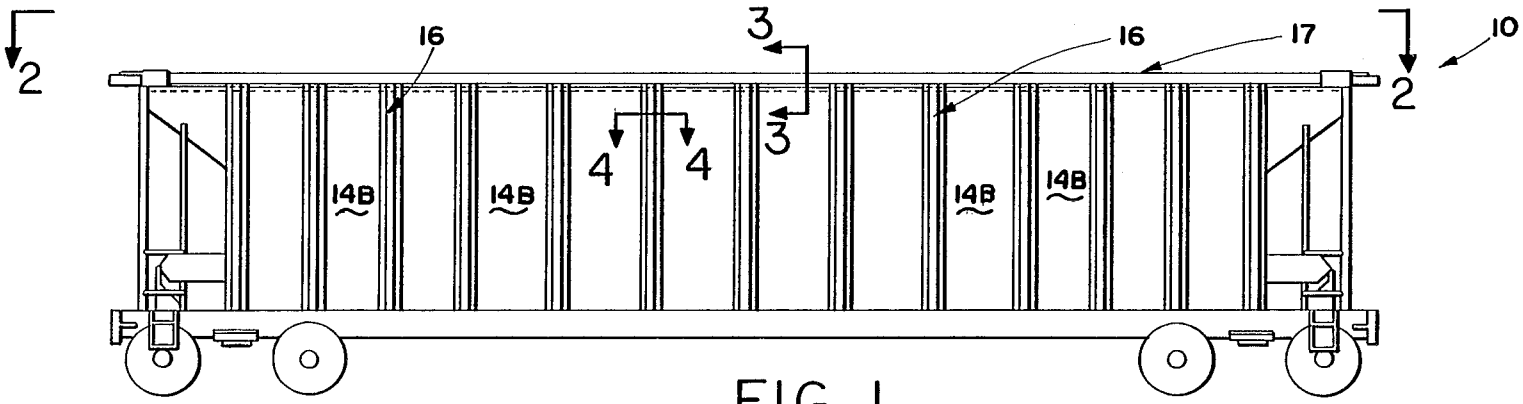
FIG. 1 is a schematic illustration of an open top coal car with a top chord constructed according to the principles of this invention.
Figure 2:
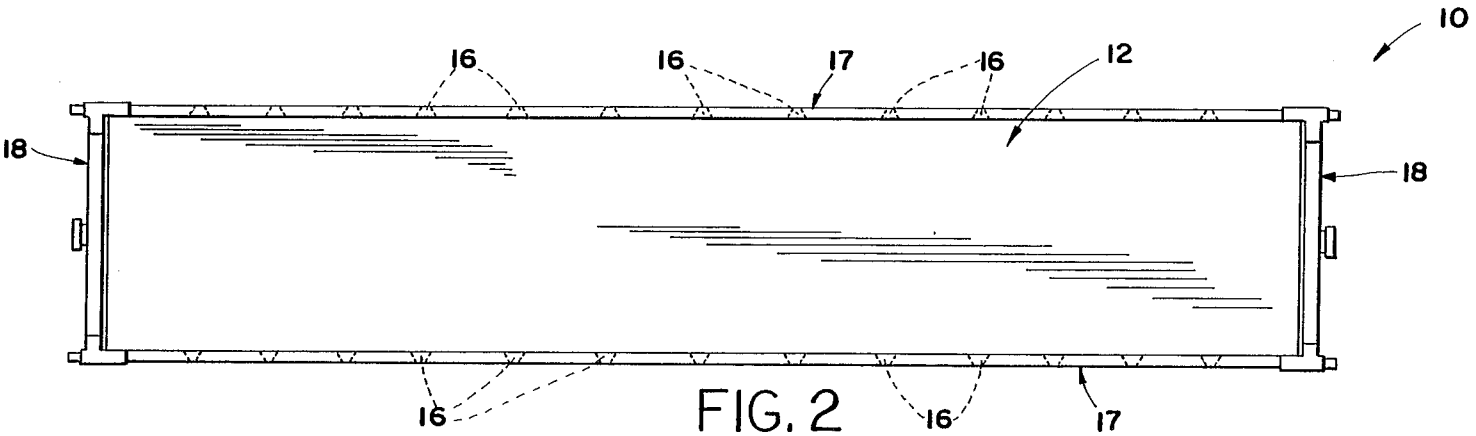
FIG. 2 is a schematic top elevational view of the railway car of FIG. 1 taken from the direction 2—2.

As discussed above, the present invention discloses a top chord structure which is particularly well suited for a railway car of the open-top hopper or gondola-type. FIGS. 1 and 2 schematically illustrate the basic structure of an open top coal car 10 with a pair of side walls and top chords constructed according to the principles of the present invention. For ease of explanation, many of the details of the coal car that are unrelated to the basic concept of the invention have been omitted, as will be readily apparent to those of ordinary skill in the art.

Figure 4:
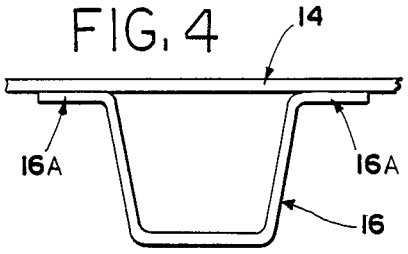
FIG. 4 is a sectional view of the car of FIG. 1, taken along the line 4—4 with section lines omitted.

Basically, the coal car 10 includes an open top container 12 having a pair of side walls 14, a series of vertically upstanding, spaced apart posts 16, a top chord 17 extending along each of the side walls 14, and a pair of end walls 18. The posts 16 are generally U-shaped with each post having a pair of co-planar flanges 16A (see FIG. 4). The side walls 14 are generally planar members. The top chords 17 are generally Pshaped, and extend along the side walls 14 of the open-top container 12. The top chords 17 interconnect with the posts 16 and the side walls 14, in a manner described more fully hereinafter, to add structural rigidity to those members.

The side walls 14 have inner surfaces 14A defining part of the inboard side of the container 12, and outer surfaces 14B defining part of the outboard side of the container 12. The posts 16 are connected with the side walls 14 with the co-planar flanges 16A of the posts connected to the outer surfaces 14B of the side walls 14 and the U-shaped walls of the posts extending outward from the side walls (see FIGS. 2 and 4). Thus, the posts 16 are on the outboard side of the railway car. Moreover, the posts 16 have upper portions 16B which extend a predetermined distance D above the side walls (see FIG. 3).

The P-shaped top chord 17 has a rectangular tubular chord section 20 and an integral stem portion 22. The stem portion 22 is connected with the posts 16 and the side walls 14, in a manner described below, with the tubular chord section 20 extending in an outboard direction, above the U-shaped post 16 (see FIGS. 3, 6 and 7).

According to the present invention, the stem 22 of the top chord includes a relatively thick proximal portion 22A extending away from the tubular chord section 20, and a relatively thinner distal end portion 22B. The thick proximal portion 22A and the thinner distal portion combine to define a step of predetermined thickness T (see FIG. 3). The thickness T of the step is designed to be substantially the same as the thickness of the side wall 14 of the hopper. Also, as seen from FIG. 3, the thick proximal portion 22A and the thinner distal portion 22B have planar profiles, which extend parallel to each other. The step extends perpendicular to the planar portions 22A and 22B of the stem.

Figure 3:
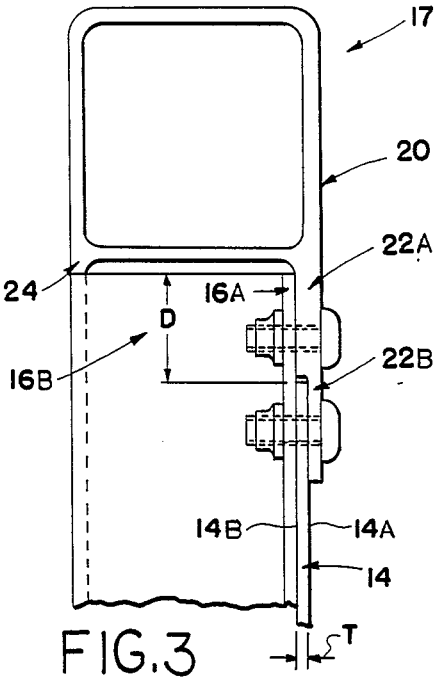
FIG. 3 is a sectional view of the car of FIG. 1, taken along the line 3—3 with section lines omitted.

As seen from FIG. 3, the thick proximal portion 22A of the stem is designed to be bolted directly to the co-planar post flanges 16A which extend above the side wall 14. The thinner portion 22B of the stem is designed to be bolted to the post flanges 16A with the upper portion of the side wall 14 sandwiched between the thinner portion 22B of the stem and the post flanges 14A. In order to bolt the stem to the post and the side wall, in the manner described above, bolts known in the trade as HUCK bolts are preferred. HUCK bolts are characterized by shafts with radial grooves (rather than spiral grooves), and by nuts that are swaged onto the shafts. Of course, it will be clear to those of ordinary skill that other mechanical fasteners (e.g., rivets) may also be used to fasten the stem of the chord with the posts and the side wall.

As seen in FIG. 3, when the stem is bolted to the side wall and to the flanges 16A of the post, the rectangular shaped tubular chord section 20 extends slightly above the post 16. A depending lip 24, integral with the rectangular chord section 20 extends downward from the chord section and is designed to rest on the top of the posts 16.

Figure 5:
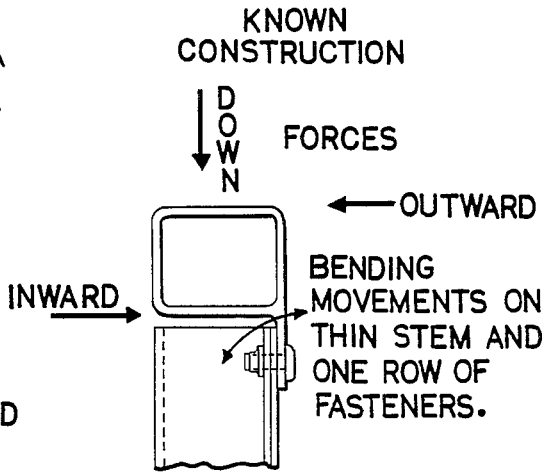
FIG. 5 schematically illustrates a known type of P-shaped chord, with the forces and bending moments superimposed thereon.

In the known P-shaped top chord of FIG. 5, the side wall is bolted directly to the stem and to the post flange. The tubular portion of the top chord would normally extend above the post. With horizontally and downwardly directed forces, as illustrated by the arrows, the tendency of the top chord is to bend about the side wall and abut the post. This type of connection stresses the chord, the side wall and the post in a way that tends to make the stem of the chord try to cock relative to the side wall when high localized bending forces are applied to the top chord. Such cocking of the stem can cause slippage in the joint area, and can cause the fasteners to loosen.

Figure 6:
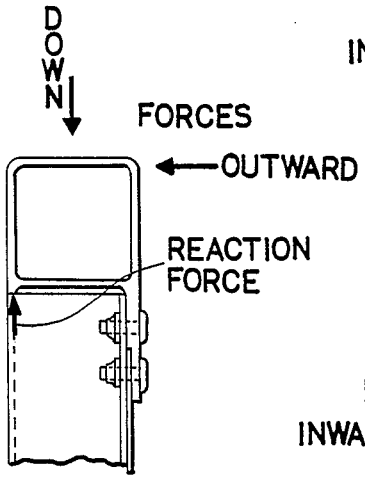
FIGS. 6 and 7 schematically illustrate the top chord of the present invention, with the resolution of forces shown thereon.
Figure 7:
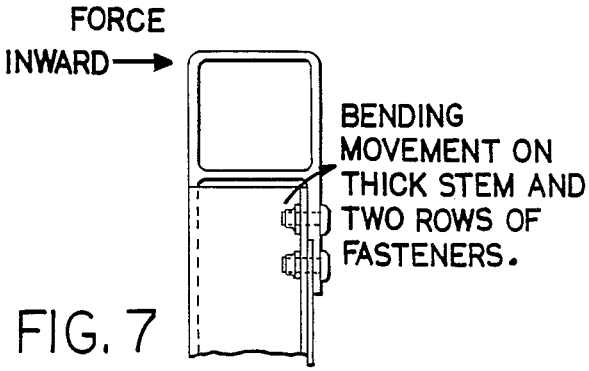

The distribution of forces on the chord, the post and the side wall in a container wall constructed according to the present invention is illustrated in FIGS. 6 and 7.

The reaction forces between the stem 22, the lip 24 and the post 16 effectively resist rotation/bending of the top chord against both outward, downward and inward directed forces. Moreover, the direct connection of the thick part of the stem with the post, and the sandwiching of the side wall between the post and the thinner part of the stem is especially effective at resisting bending under inwardly directed forces (as illustrated schematically in FIG. 7). Such structure also minimizes slippage at the points at which the stem is bolted to the post. Thus, the structure minimizes the likelihood of the fasteners loosening under the high localized forces that open top gondola-type railway cars are often subjected to. Moreover, the structure provides the type of bending resistance described above without the need for an extra reinforcing plate.

The top chord, and the other elements of the container wall of the present invention can be formed out of steel, aluminum or any other structurally strong material. They are preferably formed of aluminum. The top chord is preferably formed as an integral, extruded aluminum member.

Additionally, the principles of this invention can also be used to form a top chord and a side wall for a road transport vehicle such as a dump truck. Still further, the concepts of the invention can also be applied to the construction of plate girders and other wall structures which must withstand relatively high forces applied directly to the chords and bending moments.

With the foregoing disclosure in mind, it is believed that various additional applications for the principles embodied in the present invention will become apparent to those of ordinary skill in the art.

What is claimed is:

1. A chord for attachment to a pair of structural members, one being a planar member and the other being a reinforcing member, said chord comprising a stem for attachment to the structural members, and a chord section integral with the stem and extending transverse thereto, said stem comprising a relatively thick proximal portion connected with the chord section and a thinner distal portion cooperating with the thick portion to define a step of a predetermined width on one side of said stem, the other side of said stem being substantially planar, the thick portion of the stem comprising means for resisting bending moments action on the stem and transferring said force from the stem to the reinforcing member, said thick portion of stem further being adapted for direct engagement with the reinforcing member and the thinner distal portion adapted to sandwich the planar structural member between the thinner portion of the stem and the reinforcing member, said chord section extending transversely to said stem in a predetermined direction, said chord section having a lip member integral with the chord section and extending away from the chord section at a location spaced from the stem and in a direction generally parallel thereto, the lip being adapted for bearing on a portion of the reinforcing member.

2. A chord as defined in claim 1 wherein said chord section comprises a tubular member.

3. A chord as defined in claim 2 wherein said chord section comprises a rectangular tubular member.

4. A chord as defined in claim 3 wherein said thick proximal portion of said stem has a planar profile and said thinner distal portion of said stem has a planar profile disposed parallel to the plane of said thick portion, said stem including an integral surface defining a step between said thick and thinner portions of said stem, said surface extending perpendicular to the plane of said thin portion.

5. A chord as defined in claim 4 wherein said chord comprises an extruded aluminum member.

6. A wall structure comprising a side wall having ends, a post intermediate the wall ends, and a top chord, said side wall comprising a substantially planar member, said post having a connecting portion extending adjacent to said side wall and having a section disposed slightly above said side wall, said top chord having a chord section extending along the upper perimeter of the wall and a downwardly depending stem having at least two sides, one of the sides of said stem being substantially planar, said stem having a relatively thick proximal portion and a thinner distal portion, said thick proximal portion of said stem comprising means for resisting bending moments acting on the stem and transferring said force from the stem to said post intermediate the wall ends, said thick portion of the stem further being disposed adjacent to said section of said post extending above said side wall and being bolted thereto, the top portion of said side wall being sandwiched between and bolted to said thinner distal portion of said stem and said connection portion of said post.

7. A wall structure as defined in claim 6 wherein said post comprises a U-shaped member with a pair of coplanar flanges connected with the legs of said U-shaped member and defining said connecting portion of said post, said U-shaped member extending away from said stem portion of said chord, and said chord section having an integral lip which rests on a part of said U-shaped post to stabilize the chord section thereon.

8. A wall structure as defined in claim 7 wherein said chord section comprises a tubular member.

9. A wall structure as defined in claim 8 wherein said chord section comprises a rectangular tubular member.

10. A wall structure as defined in claim 9 wherein said thick portion of said stem has a planar profile and said thinner distal portion of said stem has a planar profile disposed parallel to the plane of said thick portion, said stem including an integral surface defining a step between said thick and thinner portions of said stem, said surface extending perpendicular to the plane of said thick portion.

11. A wall structure as defined in claim 10 wherein said chord comprises an extruded aluminum member.

12. A wall structure as defined in claim 6 wherein said thick portion of said stem has a planar profile and said thinner distal portion of said stem has a planar profile disposed parallel to the plane of said thick portion, said stem including an integral surface defining a step between said thick and thinner portions of said stem, said surface extending perpendicular to the plane of said thick portion.

13. A wall structure as defined in claim 12 wherein said chord comprises an extruded aluminum member.

14. A wall structure as defined in any of claims 6–13, wherein said wall structure forms at least a portion of a hopper wall for an open top railway car.

15. A railroad car of the open hopper car type and gondola car type which have an open top and a top chord along each side wall comprising:

a top chord which has a generally P-shaped lateral section which includes a tubular portion defined by first and second spaced apart substantially vertical parallel walls and top and bottom spaced apart substantially horizontal parallel walls which join the vertical walls;

the P-shaped section having a stepped stem depending vertically downwardly from and substantially in line with the first vertical wall;

the stem having a thick proximal portion connected to the tubular portion and a relatively thinner distal portion extending from the thick portion and with the intersection of the thick and thin portions defining a step;

each side wall of the car including a relatively flat planar member having an upper edge and a series of vertically upstanding spaced apart posts joined to the outside surface of the flat planar member;

the posts being generally U-shaped with a pair of outwardly extending coplanar flanges in contact with the outer surface of the flat planar member;

the posts having upper ends above the upper edge of the flat planar member;

the top chord tubular portion being located above but adjacent the upper ends of the posts;

the top chord stem thick proximal portion being connected directly to the post coplanar flanges above the upper edge of the flat planar member; and the top chord stem thinner distal portion being connected to the inner surface, but below the upper edge, of the flat planar member.

16. A railroad car according to claim 15 in which the top chord stem is connected to the post coplanar flanges and to the flat planar member by mechanical fasteners which extend through these elements.

17. A railroad car according to claim 15 in which:

the bottom horizontal parallel wall of the top chord tubular portion is spaced slightly above the upper ends of the posts; and the bottom of the second vertical wall of the chord tubular portion has a downwardly extending lip which rests on the upper ends of the posts.

18. A railroad car according to claim 17 in which the upper edges of the web at the base of the sides of the U-shaped posts are in line with and are in supporting contact with the downwardly extending lip.

19. A railroad car according to claim 15 in which the stem thick proximal portion is thicker than the first vertical wall.

* * * * *